US006477027B1

(12) United States Patent
McKelvy

(10) Patent No.: US 6,477,027 B1
(45) Date of Patent: Nov. 5, 2002

(54) GROUNDING MAT

(75) Inventor: Marvin D. McKelvy, Centralia, MO (US)

(73) Assignee: Hubbell Incorporated, Orange, CT (US)

( * ) Notice: Subject to any disclaimer, the term of this patent is extended or adjusted under 35 U.S.C. 154(b) by 209 days.

(21) Appl. No.: 09/585,474

(22) Filed: Jun. 2, 2000

(51) Int. Cl.[7] ..... H05F 3/00

(52) U.S. Cl. ..... 361/220; 307/326; 174/556; 361/212

(58) Field of Search ..... 361/212, 215, 361/216, 220; 307/326; 174/5 R, 55 B, 55 G

(56) References Cited

U.S. PATENT DOCUMENTS

| | | | |
|---|---|---|---|
| 993,447 A | | 5/1911 | Hotchkiss |
| 1,940,491 A | | 12/1933 | Frietag |
| 2,184,811 A | | 12/1939 | Freer et al. |
| 2,323,461 A | | 7/1943 | Donelson |
| 2,325,414 A | | 7/1943 | McChesney et al. |
| 2,456,373 A | | 12/1948 | Campaigne |
| 2,457,299 A | | 12/1948 | Biemesdefrer, Jr. |
| 3,121,825 A | | 2/1964 | Abegg et al. |
| 3,196,315 A | | 7/1965 | Peterson |
| 3,198,409 A | | 8/1965 | Anderson |
| 3,986,530 A | | 10/1976 | Maekawa |
| 4,078,107 A | | 3/1978 | Bitterice et al. |
| 4,208,696 A | | 6/1980 | Lindsay et al. |
| 4,307,144 A | | 12/1981 | Sanders et al. |
| 4,308,568 A | | 12/1981 | Whewell et al. |
| 4,388,484 A | | 6/1983 | York |
| 4,415,946 A | | 11/1983 | Pitts |
| 4,450,498 A | | 5/1984 | Siegal |
| 4,472,471 A | | 9/1984 | Klein et al. |
| 4,484,250 A | | 11/1984 | Rzepecki et al. |
| 4,491,894 A | | 1/1985 | Pitts |
| 4,589,053 A | | 5/1986 | Hosono et al. |
| 4,637,575 A | | 1/1987 | Yenzer |
| 4,699,677 A | | 10/1987 | Rooklyn |
| 4,861,645 A | | 8/1989 | Standing |
| 4,885,659 A | | 12/1989 | Nowell et al. |
| 4,970,109 A | | 11/1990 | Bryant et al. |
| 5,118,578 A | | 6/1992 | Berger et al. |
| 5,491,892 A | | 2/1996 | Fritz et al. |
| 5,646,370 A | | 7/1997 | Perkins |
| 5,835,332 A | * | 11/1998 | White et al. ..... 361/220 |

* cited by examiner

*Primary Examiner*—Brian Sircus
*Assistant Examiner*—Michael Smith
(74) *Attorney, Agent, or Firm*—Mark S. Bicks; Tara L. Hoffman; Alfred N. Goodman

(57) ABSTRACT

A grounding mat for connection to a power source, having a sheet including an outer perimeter and a central area. The outer perimeter surrounds the central area. A single continuous conductive member is attached to the sheet, the continuous conductive member having two unitary portions. The one portion is disposed in the central area of the sheet in a grid pattern, and the other portion is disposed in the outer perimeter of the sheet in a border pattern surrounding the one portion. The continuous conductive member has a connection end portion for electrical connection to the power source.

23 Claims, 2 Drawing Sheets

GROUNDING MAT

FIELD OF THE INVENTION

The present invention generally relates to a grounding mat for providing a zone of protection against electrical shock. Specifically, the grounding mat includes a flexible sheet having a continuous conductive wire sewn therein, attachable to a ground point of electrical equipment.

BACKGROUND OF THE INVENTION

Upon the operation of various electrical equipment and vehicles such as, portable and permanent substations, bucket trucks, cranes, excavating equipment, and circuit breakers, lineworkers and operators run the risk of electrocution. Typically this occurs when the lineworker comes into contact with a live wire or piece of equipment while standing on the ground, thus completing the circuit, allowing voltage to flow directly through the lineworker. This may happen either through lineworker error or a faulty ground of the electrical equipment.

Prior art protective devices cannot effectively protect a lineworker while allowing the lineworker to successfully operate the electrical equipment. Specifically, some prior art protective devices can only be used for specific applications. Other prior art protective devices are cumbersome, restricting the operation of the electrical equipment, and are costly to manufacture. Also, the prior art protective devices are not easily transported from one location to another.

Examples of prior art protective devices are disclosed in the following U.S. Pat. Nos.: 993,447 to Hotchkiss; U.S. Pat. No. 1,940,491 to Freitag; U.S. Pat. No. 3,121,825 to Abegg et al.; U.S. Pat. No. 4,078,107 to Bitterice et al.; U.S. Pat. No. 4,208,696 to Lindsay et al.; U.S. Pat. No. 4,308,568 to Whewell; U.S. Pat. No. 4,388,484 to York; U.S. Pat. No. 4,637,575 to Yenzer; U.S. Pat. No. 4,484,250 to Rzepecki et al.; U.S. Pat. No. 4,861,645 to Standing; U.S. Pat. No. 4,885,659 to Nowell et al.; U.S. Pat. No. 4,970,109 to Bryant et al.; and U.S. Pat. No. 5,491,892 to Fritz et al.

SUMMARY OF THE INVENTION

Accordingly, an object of the present invention is to provide a grounding mat that provides a lineworker with protection against electrocution from various electrical equipment.

Another object of the present invention is to provide a grounding mat that both protects the lineworker from electrocution and allows the lineworker to easily and successfully operate the electrical equipment.

A further object of the present invention is to provide a grounding mat that can be employed with various types of electrical equipment.

Yet another object of the present invention is to provide a grounding mat that can be simply and inexpensively made.

A yet further object of the present invention is to provide a grounding mat that can be easily transported from one location to another.

The foregoing objects are basically attained by providing a grounding mat for connection to a power source, comprising a sheet including an outer perimeter and a central area, the outer perimeter surrounding the central area. Only a single continuous conductive member is attached to the sheet. The continuous conductive member has unitary first and second portions, the first portion being disposed in the central area of the sheet in a grid pattern, and the second portion being disposed in the outer perimeter of the sheet in a border pattern surrounding the first portion. Additionally, the continuous conductive member has a first connection end portion for electrical connection to the power source.

Other objects, advantages and salient features of the invention will become apparent from the following detailed description, which, taken in conjunction with annexed drawings, discloses preferred embodiments of the present invention.

BRIEF DESCRIPTION OF THE DRAWINGS

Referring to the drawings which form a part of this disclosure.

DETAILED DESCRIPTION OF THE PREFERRED EMBODIMENTS

Figure 1:
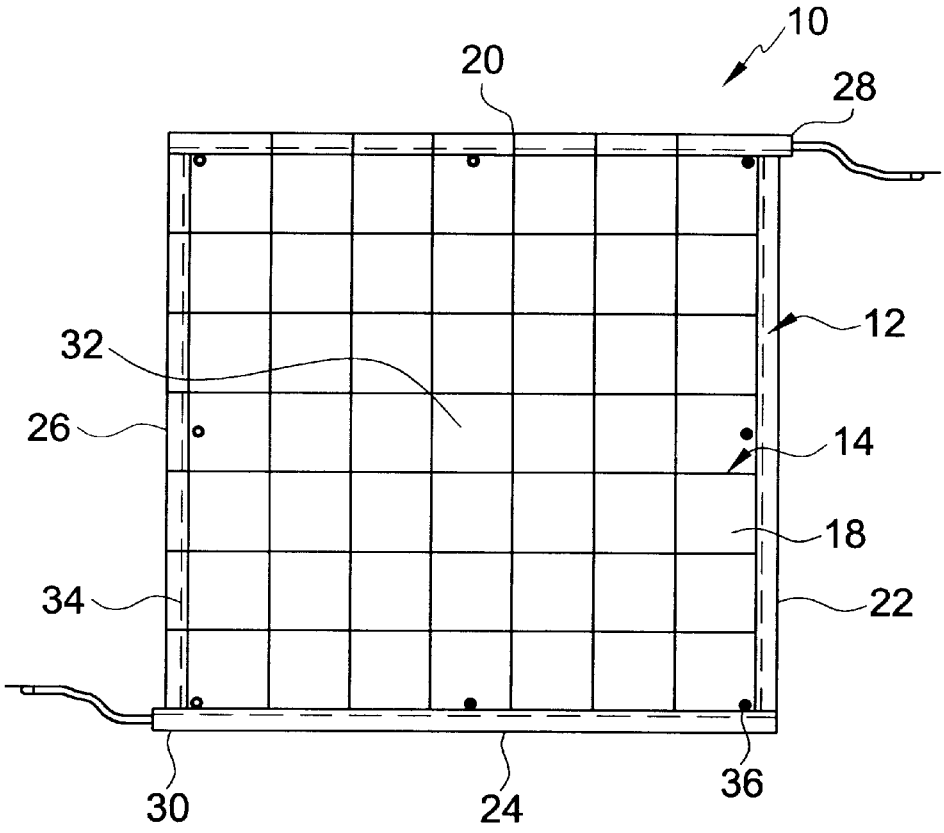
FIG. 1 is a top plan view of a grounding mat according to the present invention, illustrating the conductive wire sewn into the mat and leads extending therefrom for connection to a power source.
Figure 3:
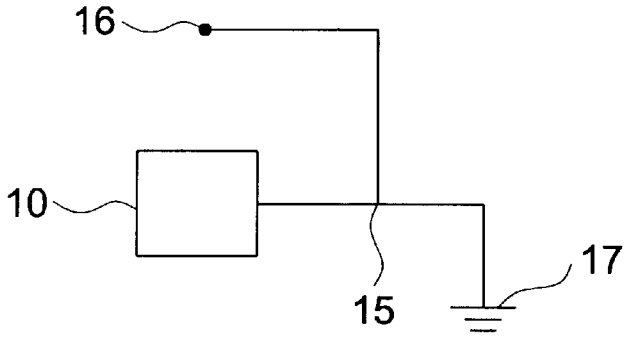
FIG. 3 is a schematic diagram of the circuit of the grounding mat illustrated in FIG. 1, electrically connected to a power source.
Figure 2:
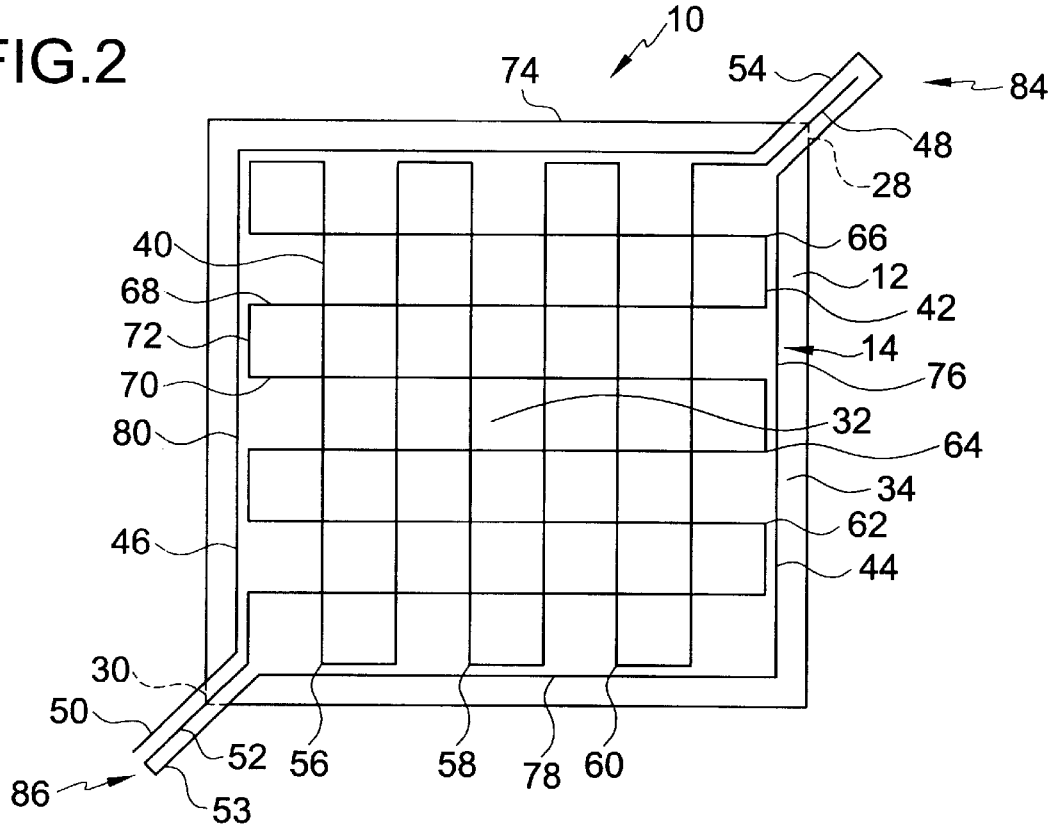
FIG. 2 is a top plan view of a first embodiment of the conductive wire of the grounding mat illustrated in FIG. 1, showing the pattern and orientation of the conductive wire on the mat.

Referring to FIGS. 1–3, a grounding mat 10, according to a first preferred embodiment of the present invention, includes a base sheet 12 with a conductive member or wire 14 attached thereto such that conductive wire 14 substantially covers base sheet 12. Mat 10, through conductive wire 14, is electrically connected to the ground point 15 of a power source 16 that is connected to a ground 17, providing a protective zone for a lineworker who is standing on mat 10 and operating live electrical equipment. In particular, mat 10 protects the worker in the event that the electrical equipment accidentally becomes energized while grounded.

Base sheet 12 is formed of any suitable material that would allow conductive wire 14 to be sewn therein. Preferably, base sheet 12 is made of a substantially flexible material such as vinyl covered polyester, but can also be formed of other materials such as, a neoprene polyester or any kind of fabric.

As seen in FIG. 1, sheet 12 includes a substantially planar top surface 18 with first, second, third, and fourth sides 20, 22, 24, 26 forming a substantially square shape, wherein first and second sides 20 and 22 meet at a first corner 28, and third and fourth sides 24 and 26 meet at a second corner 30 located remote from first corner 28. Although it is preferable that sheet 12 be square shaped, it can be of any polygonal, curved or circular shape, as long as conductive wire 14 substantially covers sheet 12. In addition, sheet 12 can be made smaller or larger as desired. Sheet 12 further includes a central area 32 where a lineworker would ideally stand while operating or working on electrical equipment at an electrical potential, and an outer perimeter 34 surrounding central area 32. Grommets 36 can be optionally included with sheet 12, so that mat 10 can be secured to the ground.

Conductive wire 14 is a single, unitary, continuous wire attached to base sheet 12 by any known attachment means, but preferably by sewing conductive wire 14 into sheet 12. As seen in FIGS. 1–3, conductive wire 14 is attached to sheet 12 in a particular pattern to substantially cover sheet 12. Wire 1 is preferably made of a tinned copper braid but can be formed of any conductive material. This design eliminates the need for any additional conductive wires since one conductive wire 14 which covers sheet 12, effectively creates a protective equipotential zone.

In particular, as illustrated in FIG. 2, conductive wire 14 includes first and second unitary portions 40 and 44 wherein first portion 40 is attached to sheet 12 in a grid pattern 42 and second portion 44 is attached in a border pattern 46 surrounding the grid pattern 42. First portion 40 includes a first end section 48, which is the beginning of conductive wire 14, and second portion 44 includes a second end section 50, which is the termination of conductive wire 14, with transition sections 52 and 53 connecting first and second portions 40 and 44 forming one continuous wire.

The grid pattern 42 of first portion 40 is defined by a first series of rows 56, 58, and 60 and a second series of rows 62, 64, and 66 overlapping the first series of rows 56, 58, and 60 at a substantially ninety degree angle wherein rows 58 and 64 are centrally disposed and rows 56 and 62, and rows 60 and 68 are disposed on either side of rows 58 and 64, respectively. Each of the rows comprise parallel first and second lines 68 and 70 connected at one end by an intermediate line 72.

Transition section 52 of first portion 40 extends from grid pattern 42 into transition section 53 of second portion 44 after one ninety degree turn. The border pattern 46 of second portion 44 includes opposing first and third border lines 74 and 78 that each extend parallel to rows 62, 64, and 66 proximate intermediate lines 72 of rows 56, 58, and 60, and opposing second and fourth border lines 76 and 80 extend between first and third border lines 74 and 78 proximate intermediate lines 72 of rows 62, 64, and 66. In addition, between first and second border lines 74 and 76, another transition section 54 extends around first end section 48 of first portion 40 through two ninety degree turns with second portion 44 terminating at second end section 50 near transition sections 52 and 53 of first and second portions 40 and 44. This design forms a substantially square continuous border around grid pattern 42.

Upon attachment to sheet 12 of mat 10, the grid pattern 42 of first portion 40 of conductive wire 14 is disposed in central area 32 and the border pattern 46 of second portion 44 is disposed in outer perimeter 34 of sheet 12. Thus, conductive wire 14 substantially covers sheet 12. In addition, first, second, third, and fourth border lines 74, 76, 78, and 80 of second portion 44 are each brought into intimate contact with the intermediate lines 72 of first series of rows 56, 58, and 60 and second series of rows 62, 64, and 66 of first portion 40 and subsequently attached to sheet 12 proximate first, second, third, and fourth sides 20, 22, 24, and 26, respectively. Also, sheet 12 is folded over at each of first, second, third, and fourth sides 20, 22, 24, and 26, as best seen in FIG. 1. Similarly, first end section 48 of first portion 40 is mated with transition section 54 of second portion 44 to form a first connection end portion or lead 84 extending beyond outer perimeter 34 proximate first corner 28 of sheet 12 for connection to ground point 15 of power source 16. Likewise, an opposing second connection end portion or lead 86 is formed by mating transitions sections 52 and 53 of first and second portions 40 and 44, respectively, such that second connection end portion 86 extends beyond outer perimeter 34 proximate second corner 30 of sheet 12.

By bringing first and second portions 40 and 44 into intimate contact along the periphery of conductive wire 14, as described above, any severing of wire 14 will not be fatal since the current flowing therethrough will have a plurality of travel paths to take.

Although it is preferable that conductive wire 14 be attached to sheet 12 using grid and border patterns 42 and 46, various patterns can be employed in different orientations, as long as one continuous wire is employed that covers a substantial portion of sheet 12.

Mat 10 can be electrically connected to power source 16 through either first or second leads 84 and 86 by any known connection, such as a lug terminal coupled with a ball stud (not shown). Specifically, any cable can be attached to the ball stud which in turn is coupled to one of leads 84 and 86 via the lug terminal. The cable, which extends to the ground point 15 of the equipment, thus electrically connecting mat 10 and power source 16. In addition, any known suitable ground clamp can be connected to one of leads 84 and 86.

Leads 84 and 86 also allow mat 10 to be electrically connected to a second mat that is substantially identical to mat 10 if for example a larger protective zone is desired. The leads of the respective ground mats can be connected in any conventional manner. Preferably, the leads of the two mats are electrically connected by inserting a fastener, such as a bolt, through the lug terminals of each lead of a respective grounding mat. Alternatively, two mats can be joined by coupling a single ball stud with each lead of a respective mat. The ball stud can then be connected to a cable leading to a power source or connected to a ground.

Upon connection to a power source 16 of a piece of electrical equipment, mat 10 will provide a protective equipotential zone for a lineworker standing on top surface 18 of mat 10. Specifically, under normal conditions, the electrical equipment is de-energized and properly grounded by ground 15. Without mat 10, in case of a faulty ground of the electrical equipment or contact with a live cable or wire, the lineworker's hands will be at the potential of the power source and the lineworker's feet will be at ground potential, allowing the current to flow through the lineworker. However, upon connecting grounding mat 10 to power source 16, with the lineworker standing on mat 10, that lineworker's hands and feet are maintained at the same electrical potential as power source 16, creating a zone of equipotential, limiting the flow of current through the lineworker, as represented in FIG. 3, until the electrical potential of the power source is deactivated.

Figure 4:
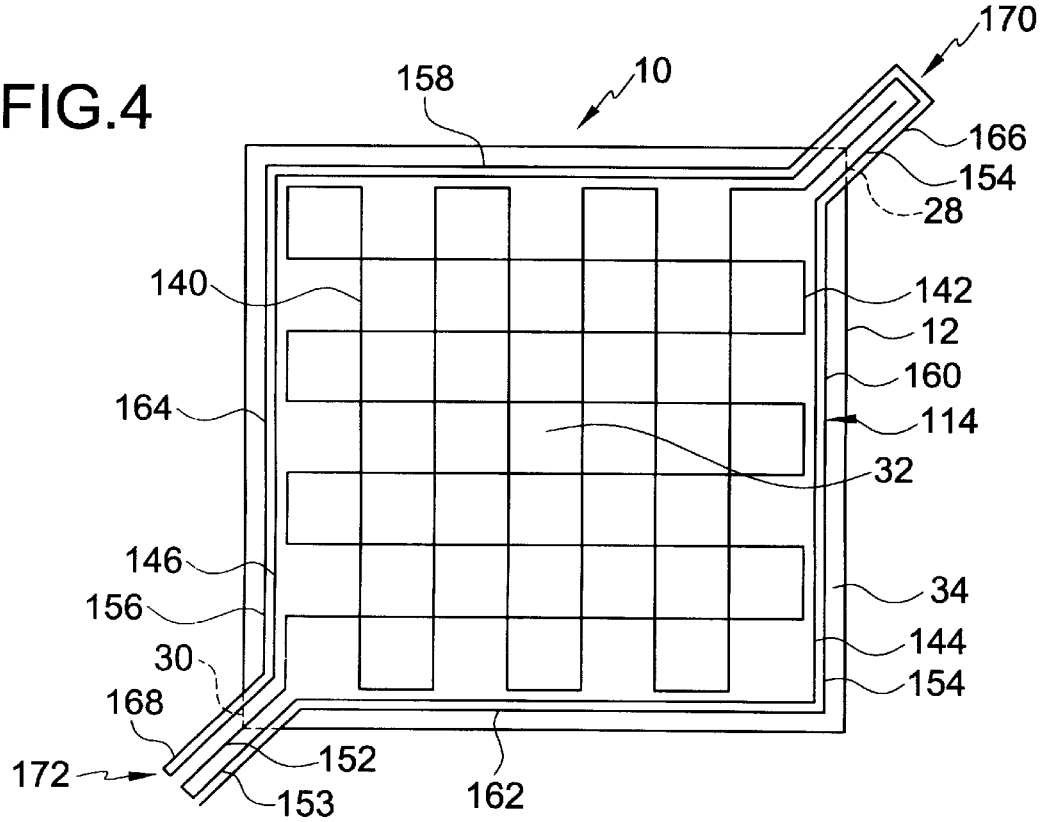
FIG. 4 is a top plan view of a ground mat according to a second embodiment of the present invention, showing an alternative pattern and orientation of the conductive wire on the mat.

Referring to FIG. 4, a second embodiment of a conductive wire 114 attachable to sheet 12, is substantially similar to conductive wire 14 except for the addition of a second border pattern 156. Specifically, conductive wire 114 includes a first portion 140 attached in a grid pattern 142 and a second portion 144 attached in a border pattern 146 in the same fashion as described above for conductive wire 14. However, conductive wire 114 additionally includes a third portion 154 attached to sheet 12 in a second border pattern 156. In particular, third portion 154 continues from second portion 144 and includes opposing first and third borderlines 158 and 162, and opposing second and fourth border lines 160 and 164 which form a continuous border around second portion 144 and first portion 140 in the same manner as second portion 44 of conductive wire 14. In addition, opposing transition sections 166 and 168 of third portion 154 extend around transitions sections 152 and 153, and 154, respectively, of first and second portions 140 and 144.

Conduction wire 114 is attached to sheet 12 in the same manner as described above with respect to conductive wire 14. Specifically, upon attachment of conductive wire 114 to sheet 12, grid pattern 142 of first portion 140 is disposed in central area 32 and border pattern 146 of second portion 144 and second border pattern 156 of third portion 154 are both disposed in outer perimeter 34 of sheet 12.

Also, first, second, third, and fourth border lines 158, 160, 162, and 168 of third portion 154 are each brought into intimate contact with first and second portions 140 and 144 in a similar manner as described above with respect to of conductive wire 14. Likewise, transition sections 166 and 168 are each brought into contact with first and second portions 140 and 144, to form first and second connection end portions 170 and 172 which extend beyond outer perimeter 34 near first and second corners 28 and 30 of sheet 12, respectively, for connecting to a power source.

While particular embodiments have been chosen to illustrate the invention, it will be understood by those skilled in the art that various changes and modifications can be made therein without departing from the scope of the invention as defined in the appended claims.

What is claimed is:

1. A grounding mat for connection to a power source, comprising:

a sheet including an outer perimeter defined along at least a first side of said sheet and a central area, said outer perimeter surrounding said central area; and only a single continuous conductive member attached to said sheet, said continuous conductive member having unitary first and second portions, said first portion being disposed in said central area of said sheet in a grid pattern, and said second portion being disposed in said outer perimeter of said sheet in a border pattern surrounding said first portion, said first and second portions being in contact along said first side of said sheet, and said continuous conductive member having a first connection end portion for electrical connection to the power source.

2. A grounding mat according to claim 1, wherein said first and second portions are in contact at said first connection end portion.

3. A grounding mat according to claim 2, wherein said first connection end portion extends beyond said outer perimeter of said sheet.

4. A grounding mat according to claim 3, wherein said sheet includes a second side meeting said first side at a first corner, and said first connection end portion is located proximate said first corner.

5. A grounding mat according to claim 4, wherein said first and second portions of said continuous conductive member are in contact at said second side.

6. A grounding mat according to claim 5, wherein said sheet includes third and fourth sides meeting at a second corner; and said first and second portions of said continuous conductive member are in contact at each of said third and fourth sides.

7. A grounding mat according to claim 1, wherein said grid pattern being defined by unitary first and second series of rows with said second series of rows overlapping said first series of rows at a substantially ninety degree angle.

8. A grounding mat according to claim 1, wherein said continuous conductive member includes a second connection end portion disposed remote from said first connection end portion.

9. A grounding mat according to claim 1, wherein said continuous conductive member includes a third portion forming a second border pattern that surrounds said first and second portions.

10. A grounding mat according to claim 1, wherein said sheet is formed of a flexible material, and said continuous conductive member is sewn into said sheet.

11. A grounding mat according to claim 10, wherein said sheet is made of a vinyl coated polyester; and said continuous conductive member is a copper braid.

12. A grounding mat connected to a power source, comprising:

a sheet including an outer perimeter defined along at least a first side of said sheet and a central area, said outer perimeter surrounding said central area;

only a single continuous conductive member attached to said sheet, said continuous conductive member having unitary first and second portions, said first portion being disposed in said central area of said sheet in a grid pattern, and said second portion being disposed in said outer perimeter of said sheet in a border pattern surrounding said first portion, said first and second portions being in contact along said first side of said sheet, and said continuous conductive member having a first connection end portion; and a power source electrically connected to said first connection end portion of said continuous conductive member.

13. A grounding mat connected to a power source according to claim 12, wherein said continuous conductive member includes a third portion forming a second border pattern that surrounds said first and second portions.

14. A grounding mat connected to a power source according to claim 13, wherein said third portion is in contact with said first and second portions at said first side.

15. A grounding mat connected to a power source according to claim 12, wherein said first connection end portion extends beyond said outer perimeter of said sheet and connects to a ground point of said power source.

16. A grounding mat connected to a power source according to claim 12, wherein said continuous conductive member includes a second connection end portion disposed remote from said first connection end portion, said second connection end portion being connected to a second grounding mat.

17. A grounding mat connected to a power source according to claim 12, wherein said sheet is formed of a flexible material; and said continuous conductive member is sewn into said sheet.

18. A grounding mat connected to a power source according to claim 12, wherein said outer perimeter is defined along a second side of said sheet substantially perpendicular to said first side; and said first and second portions being in contact along said second side.

19. A grounding mat connected to a power source, comprising:

a sheet including a central area, an outer perimeter surrounding said central area, and first and second sides meeting at a first corner;

only a single continuous conductive member having, unitary first and second portions, said first portion being disposed in said central area of said sheet in a grid pattern, said grid pattern being defined by unitary first and second series of rows with said second series of rows overlapping said first series of rows at substantially ninety degree angles, and said second portion being disposed in said outer perimeter of said sheet in a border pattern, said border pattern being defined by a perimeter surrounding said grid pattern of said first portion, and said first and second portions being in contact along said first and second sides, and a first connection end portion extending beyond said outer perimeter proximate said first corner of said sheet; and a power source electrically connected to said first connection end portion of said continuous conductive member.

20. A grounding mat connected to a power source according to claim 19, wherein said first and second portions are in contact at said first connection end portion, and said first connection end portion extends beyond said outer perimeter proximate said first corner of said sheet and is connected to a ground point of said power source.

21. A grounding mat connected to a power source according to claim 19, wherein said continuous conductive member includes a third portion forming a second border pattern that surrounds said first and second portions.

22. A grounding mat connected to a power source according to claim 19, wherein said continuous conductive member includes a second connection end portion located remote from said first connection end portion, said second connection end portion being connected to a second grounding mat.

23. A grounding mat connected to a power source according to claim 22, wherein said sheet includes third and fourth sides meeting at a second corner; and said second connection end portion extending beyond said outer perimeter proximate said second corner of said sheet.

* * * * *